US005892526A

United States Patent [19]

Asai

[11] Patent Number: 5,892,526

[45] Date of Patent: Apr. 6, 1999

[54] SUBSTRATE FOR LIQUID JET RECORDING HEAD FOR PRODUCING CONSISTENTLY SHAPED INK BUBBLES, LIQUID JET RECORDING HEAD PROVIDED WITH SAID SUBSTRATE AND METHOD OF RECORDING WITH SAID RECORDING HEAD

[75] Inventor: Akira Asai, Atsugi, Japan

[73] Assignee: Canon Kabushiki Kaisha, Tokyo, Japan

[21] Appl. No.: 474,967

[22] Filed: Jun. 7, 1995

Related U.S. Application Data

[63] Continuation of Ser. No. 180,474, Jan. 12, 1994, abandoned, which is a continuation of Ser. No. 711,413, Jun. 5, 1991, abandoned, which is a continuation of Ser. No. 622,141, Dec. 4, 1990, abandoned, which is a continuation of Ser. No. 379,176, Jul. 13, 1989, abandoned.

[30] Foreign Application Priority Data

Jul. 15, 1988 [JP] Japan ..... 63-175241

[51] Int. Cl.[6] ..... B41J 2/05

[52] U.S. Cl. ..... 347/62; 347/63

[58] Field of Search ..... 347/62, 61, 57, 347/56, 64, 63

[56] References Cited

U.S. PATENT DOCUMENTS

| | | | |
|---|---|---|---|
| 4,313,124 | 1/1982 | Hara | 347/57 |
| 4,339,762 | 7/1982 | Shirato | 347/62 |
| 4,514,741 | 4/1985 | Meyer | 347/62 |
| 4,719,478 | 1/1988 | Tachihara et al. | 347/62 |
| 4,723,129 | 2/1988 | Endo | 347/56 |
| 4,740,796 | 4/1988 | Endo | 347/56 |
| 4,792,818 | 12/1988 | Eldridge | 347/63 |
| 4,887,099 | 12/1989 | Terai | 347/63 |
| 4,968,992 | 11/1990 | Komuro | 347/64 |

FOREIGN PATENT DOCUMENTS

| | | |
|---|---|---|
| 59-31943 | 2/1984 | Japan . |
| 59-34506 | 2/1984 | Japan . |
| 59-95155 | 6/1984 | Japan . |
| 60-236758 | 11/1985 | Japan . |
| 62-103148 | 5/1987 | Japan . |
| 62-201255 | 9/1987 | Japan . |

OTHER PUBLICATIONS

A, Asai, et al., *Journal of Imaging Technology*, "Bubble Generation Mechanism in the Bubble Jet Recording Process", vol. 14, No. 5, pp.120–124 (1988).

*Primary Examiner*—Joseph Hartary
*Attorney, Agent, or Firm*—Fitzpatrick, Cella, Harper & Scinto

[57] ABSTRACT

A liquid jet recording head includes a substrate having a support and an electricity-heat converter arranged on the support. The heater converter includes a heat-generating resistor layer and a pair of electrodes electrically connected to the heat-generating resistor, with a heat-generating portion being formed between the pair of of electrodes. The heat generating portion includes a deforming portion that is at a temperature lower than the other portions of the heat generating portion during driving of the electrodes so as to produce a consistently shaped ink bubble and reduce random boiling. The invention also relates to a method of recording with the liquid jet recording head.

10 Claims, 8 Drawing Sheets

$C_1 : C_2 \approx \ell_2 : \ell_1 \, (Z_2 > Z_1)$

SUBSTRATE FOR LIQUID JET RECORDING HEAD FOR PRODUCING CONSISTENTLY SHAPED INK BUBBLES, LIQUID JET RECORDING HEAD PROVIDED WITH SAID SUBSTRATE AND METHOD OF RECORDING WITH SAID RECORDING HEAD

This application is a continuation of application Ser. No. 08/180,474 filed Jan. 12, 1994, now abandoned, which in turn was a continuation of application Ser. No. 07/711,413 filed Jun. 5, 1991, now abandoned, which in turn was a continuation of application Ser. No. 07/622,141 filed Dec. 4, 1990, now abandoned, which in turn was a continuation of application Ser. No. 07/379,176 filed Jul. 13, 1989 now abandoned.

BACKGROUND OF THE INVENTION (1) Field of the Invention

This invention relates to a liquid jet recording head and a substrate to be used for said recording head, and particularly to a liquid jet recording head which boils a liquid for recording by permitting heat energy to act on the liquid, thereby jetting (discharging) droplets to effect recording, and a substrate including an electricity-heat converter which generates the above heat energy corresponding to passage of current.

(2) Related Background Art

The system of discharging a liquid by utilizing abrupt growth (expansion) and shrinkage of bubbles generated by permitting heat energy to act on the liquid has been known in the art (U.S. Pat. Nos. 4,723,129, 4,740,796, etc.).

This system is suitable for high speed recording, which is a system extremely suited for higher densification, higher image quality, and is attracting attention particularly in recent years.

Desired properties for the liquid jet recording head or the electricity-heat converter to be used in this system, include a high response characteristic during high speed driving, capability of sufficient heating for boiling of a liquid, and in addition thereto, high durability. For that purpose, various improvements have been done in aspects of material and constitution.

For example, Japanese Patent Publication No. 59-34506 discloses, in order to enhance response characteristic and heating performance, an electricity-heat converter which has a lower layer, a heat-generating resistor layer and an upper layer, and also disclose the conditions which should be satisfied in relations to the thickness and the material constants of the respective layers.

Japanese Laid-open Patent Application No. 60-236758 discloses a protective layer which is made thinner on the heat-generating portion for enhancing durability.

During repeated generation and disappearance of bubbles concerned with liquid discharging (main bubbles or primary bubbles), if there is a portion of a substrate higher in temperature than the heating limit temperature, and that position is different from the portion where the mainbubbles defoam on the heat-acting portion, there will occur a phenomenon that secondary bubbles in streaks remain along the flow directional at that position. Since cavitation of such secondary bubbles is very great as compared with that of main bubbles, it may sometimes deteriorate the upper protective layer at that portion, even deteriorating the electricity-heat converter to reduce durability.

In the invention disclosed in Japanese Laid-open Patent Application No. 62-103148, by calling attention to the fact that the central part of the heat-acting portion becomes high in temperature when the upper layer and the lower layer of the electricity-heat converter are uniform in thickness, the central region of the heat-acting portion of at least one of the lower layer and the upper layer of the electricity-heat converter is made thinner in film thickness than other regions. Thus, heat dissipatability at that portion is enhanced, and during driving (during current passage through the electricity-heat converter), uniform temperature elevation is effected over the central part and the peripheral part of the heat-acting portion. Further, during defoaming of main bubbles after driving, the temperature of the central part of the heat-acting portion drops to the heating limit temperature or lower.

Also, in Japanese Laid-open Patent Application No. 59-95155, in order to prevent the above cavitation damage, an electroconductive region is provided at the central part of the electricity-heat converter (resistor), and that part is adapted to be not concerned with foaming, namely so that an annular bubble may be formed at the portion surrounding that portion, and a plurality of small bubbles may be distributed randomly on the heat-acting portion during defoaming.

However, in a recording head having an electricity-heat converter as the discharging energy generating means, in addition to the above conditions, high reproducibility of boiling is demanded.

According to the present inventors of the present application, it has been confirmed that, when a liquid is boiled repeatedly, and bubbles generated by a previous driving signal (heating pulse) of to the electricity-heat converter disappear, microscopic residual gas attaches randomly on the surface of the electricity-heat converter, which becomes the foaming nucleus at the initial bubble generation stage in the subsequent pulse heating, whereby reproducibility may not be ensured. However, this point has not be particularly considered in the prior art.

If the boiling phenomenon is not stabilized, the bubbles generated will not be constant in shape and size, and therefore variance occurs in droplet diameter and discharging speed, which can further bring about such problems as lowering in image quality.

SUMMARY OF THE INVENTION

An object of the present invention is to provide a recording head with high reproducibility of boiling, and a substrate therefor.

Another object of the present invention is to provide a liquid jet recording head without occurrence of variance in droplet diameter and discharging speed, capable of forming images of high quality.

Still another object of the present invention is to provide a substrate for liquid jet recording head, comprising:

a support; and an electricity-heat converter arranged on said support, having a heat-generating resistor layer and a pair of electrodes electrically connected to said heat-generating resistor, with a heat-generating portion being formed between said pair of electrodes, characterized in that $\Delta T=T_H-T_o$ is 20° C. or more and 100° C. or less ($T_o$ is the peak value of the temperature of said electricity-heat converter under driven state when no liquid for recording exists at the position of the surface of said substrate corresponding to said heat-generating portion on said surface where the bubble generated in the liquid for recording disappears; and $T_H$ is the peak value of the temperature of said electricity-heat converter under driven state when no liquid for recording exists at other positions than the above position).

Still another object of the present invention is to provide a liquid jet recording head comprising:

a substrate having a support; and an electricity-heat converter arranged on said support, having a heat-generating resistor layer and a pair of electrodes electrically connected to said heat-generating resistor, with a heat-generating portion being formed between said pair of electrodes; where $\Delta T=T_H-T_o$ being 20° C. or more and 100° C. or less; and a member provided on said substrate for forming the liquid channel for said liquid for recording ($T_o$ is the peak value of the temperature of said electricity-heat converter under driven state when no liquid for recording exists at the position of the surface of said substrate corresponding to said heat-generating portion on said surface where the bubble generated in the liquid for recording disappears; and $T_H$ is the peak value of the temperature of said electricity-heat converter under driven state when no liquid for recording exists at other positions than the above position).

Yet another object of the present invention is to provide a method of recording on a recording medium by emitting a liquid using a liquid jet head, the liquid jet head including a device for emitting the liquid, the liquid emitting device having an electricity-heat converter including a heat-generating resistor layer and a pair of electrodes electrically connected to the heat-generating resistor layer for receiving driving signals, and a heat-generating portion being formed on the heat-generating portion having a defoaming position. The method includes the step of applying driving signals to the heat generating resistor layer so that the deforming position is at a temperature $T_o$, with $T_o$ being the peak value of the temperature of the deforming position when driving signals are applied to the heat-generating resistor layer and when liquid for recording is not present, and so that positions of the heat-generating portion other than the defoaming position are at a temperature $T_H$, with $T_H$ being the peak value of the temperature of the other positions of the heat-generating portion when driving signals are applied to the heat-generating resistor layer and when liquid for recording is not present, wherein a temperature difference $\Delta T$ between the defoaming position and the other positions of the heat-generating portion is defined as $\Delta T=T_H-T_o$ and 20° C.$\leqq\Delta T\leqq$100° C.

DESCRIPTION OF THE PREFERRED EMBODIMENTS

Figure 1A:
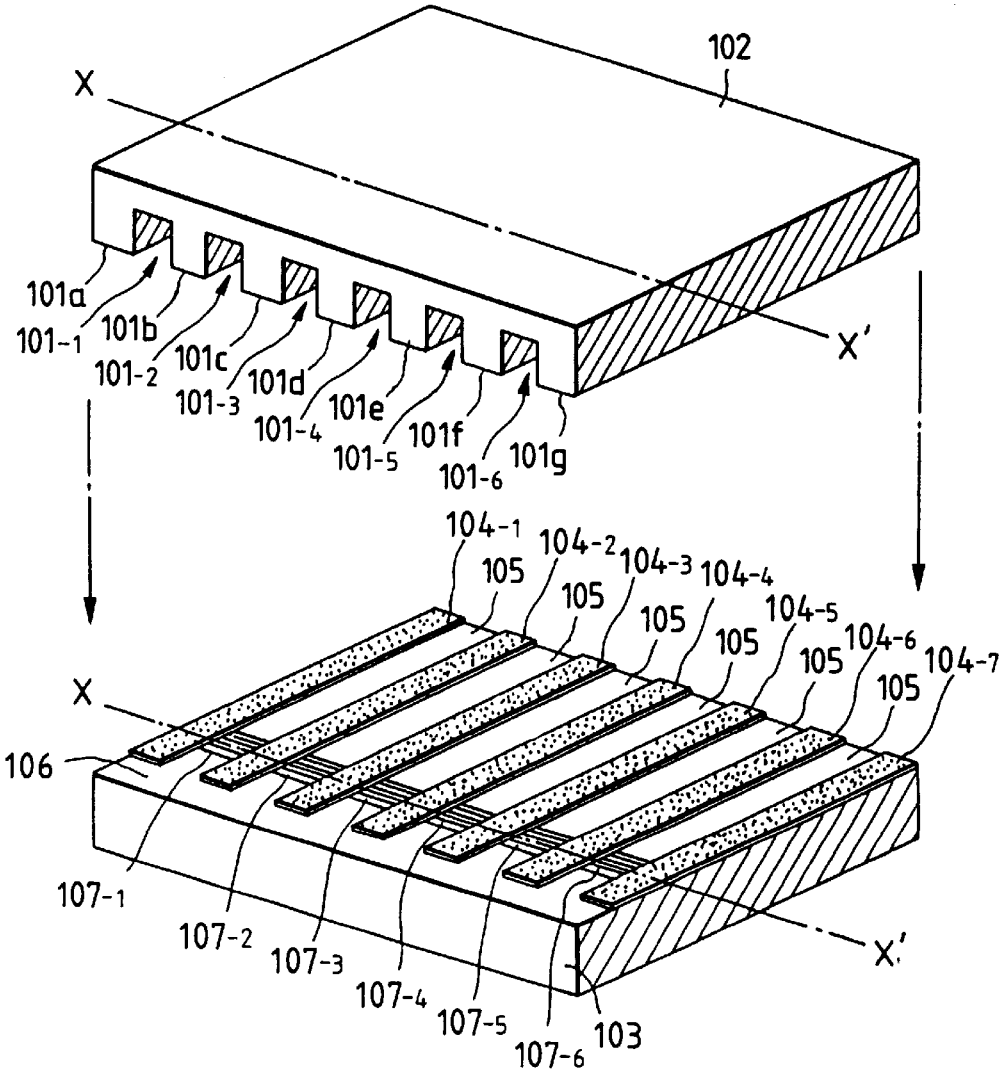
FIG. 1A PRIOR ART
FIGS. 1A and 1B are respectively an exploded perspective view and a front view of the liquid jet recording head according to an example of the present invention.

In the substrate for liquid jet recording head according to the present invention, there are provided a support and an electricity-heat converter, arranged on the support, having a heat-generating resistor layer and a pair of electrodes electrically connected to the heat-generating resistor layer, with a heat-generating portion being formed between the pair of electrodes, and $\Delta T=T_H-T_o$ is made 20° C. or higher and 100° C. or lower.

Also, in the liquid jet recording head according to another mode of the present invention, there are provided a substrate having a support, an electricity-heat converter arranged on said support, having a heat-generating resistor layer and a pair of electrodes electrically connected to said heat-generating resistor, with a heat-generating portion being formed between said pair of electrodes, with $\Delta T=T_H-T_o$ being 20° C. or higher and 100° C. or lower, and a member provided on said substrate for forming the liquid channel for said liquid for recording.

In these, $T_o$ is the peak value of the temperature of said electricity-heat converter in a driven state when no liquid for recording exists at the position of the surface of said substrate corresponding to said heat-generating portion where the bubble generated in the liquid for recording on said surface disappears; and $T_H$ is the peak value of the temperature of said electricity-heat converter in a driven state when no liquid for recording exists at other positions than the above position.

According to the present invention, the portion corresponding to the bubble disappearing position on the heat acting surface is lower in temperature than other portions during driving, and therefore the heat flux to be transmitted when a liquid is introduced becomes smaller at that portion. For this reason, even when microscopical residual gas may be attached at that portion after bubble disappearance, the gas will not become the foaming nucleus during subsequent driving.

Also, by constitution with an adequate choice of said temperature difference, high discharging performance can be maintained, and along therewith, reproducibility of boiling can be improved, and hence a good recording quality can be obtained.

The present invention is described in detail below by referring to the drawings.

Figure 1B:
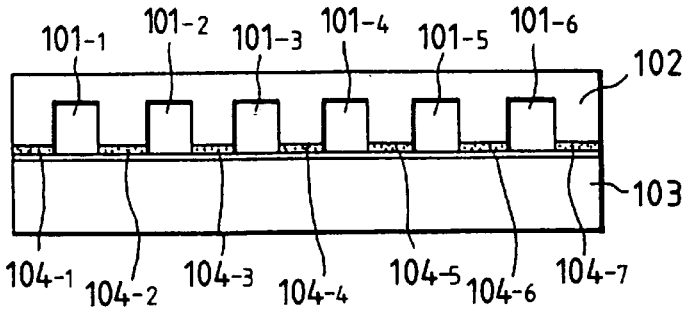
FIG. 1B PRIOR ART

FIGS. 1A and 1B are respectively a perspective view and a sectional view taken along the line X-X' thereof showing a liquid jet recording head having a plurality of discharging portions including a plurality of liquid channels, electricity-heat converters and discharging openings (orifices), as an example of the liquid jet recording head to which the present invention is applicable.

In these Figures, an electricity-heat converter having heat-generating resistors 107 (107-1 to 107-6), and a common electrode 106 and selective electrodes 105 as the electrodes for current passage arranged on the substrate 103. The substrate is bonded with the adhesive layers 104 (104-1 to 104-7) so that the heat-generating resistors just coincide with the grooves 101 (101-1 to 101-6) restricted by the partitioning walls 101*a* to 101*g* formed on the grooved lid plate 102. By introducing a liquid (ink) and heating the heat-generating resistors 107 by current passage, bubbles are formed by abrupt change in the state of the liquid on the heat-generating resistors 107, whereby droplets corresponding to the volume increase are discharged through the orifices formed by the grooved lid plate 102 and the subsrate 103.

The heat-generating resistor 107 according to the present invention, as described later, becomes lower in surface temperature in the region corresponding to the bubble disappearance position than in other positions, and in order to maintain a good discharging state, an adequate temperature is obtained by making the thickness of the heat-accumulating layer as the lower layer in said region, and by choosing also the size of said region adequately.

Here, first the bubble disappearance position (defoaming position) is to be speculated.

The defoaming position is determined depending on the shape of the liquid channel, the position of the heat-generating resistor arranged therein, temperature and other environmental conditions, and influenced by the inertia component Z of the hydromechanical impedance in the flow area around the bubble. The inventors of the present application have confirmed that defoaming occurs around the position where the heat-generating resistor is proportionally distributed with the reciprocal ratio of Z.

Here, concerning the flow area of interest, the position taken in the flow direction is defined as x, the sectional area at the position x of the flow area as S(x), the length of the flow area as l and the density of the fluid (liquid for recording) as ρ, the inertia component Z of the impedance of the flow area is determined by:

$$Z = \int_0^l [\rho/S(x)]dx \tag{1}$$

Figure 2:
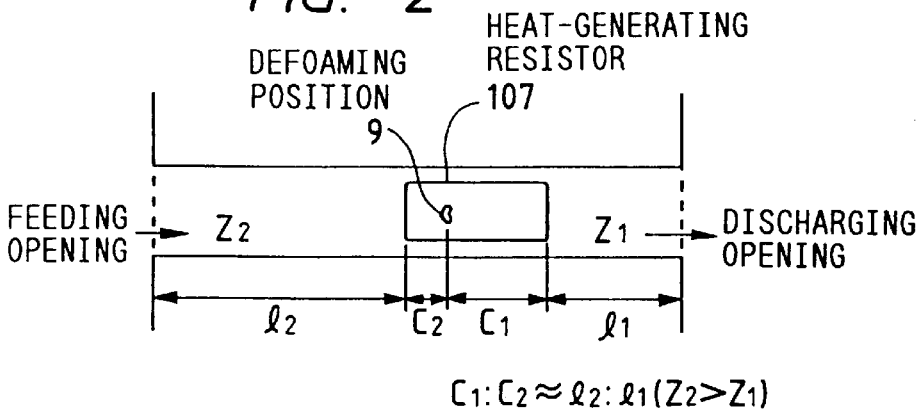
FIG. 2 diagrammatic representation for illustration the defoaming position.

For example, as shown in FIGS. 1A and 1B, in the form where the feeding direction and the discharging direction of the liquid are coincident relative to the heat-generating resistor 107, as shown in FIG. 2, if the sectional area S(x)=S=constant, $$Z_1=\rho l_1/S, Z_2=\rho l_2/S \tag{2}$$

$$C_1:C_2=Z_2:Z_1=l_2:l_1 \tag{3}$$

That is, defoaming occurs at around the position determined by these relationship formulae.

Accordingly, various conditions may be determined so that the heat reflux transmitted to the liquid in the upper portion at the site including that site may become small.

Having described above the general relationships, when the height of the nozzle ceiling at the position x is defined as h(x) for the purpose of convenience, it has been also found to be sufficiently valid that the bubble disappears at the position where $$w_1 = \int_0^{l^1} [1/h(x)]dx,\ w_2 = \int_0^{l^2} [1/h(x)]dx, \tag{4}$$

and $$C_1:C_2 = w_2:w_1.$$

Next, speculation is made about how much temperature difference should exist between the region including said defoaming position and other regions for maintaining good discharging performance.

Figure 3:
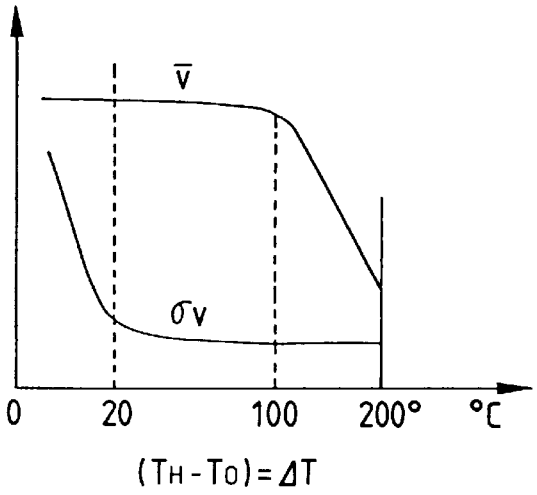
FIG. 3 is a diagrammatic representation for illustration of the optimum temperature range for discharging.

FIG. 3 plots the average value $\bar{v}$ of droplet discharging speed and the standard deviation σv of the speed versus the difference ΔT (=$T_H$−$T_o$) between the peak value $T_H$ of the surface temperature of the heat-generating resistor and the peak value $T_0$ of the surface temperature corresponding to the region where the heat-accumulating layer is made thinner. However, here, the temperature difference ΔT is the value where no ink is permitted to exist within the liquid channel.

As is apparent from the graph, it has been confirmed that if the temperature difference ΔT is 20° C. or more, σv becomes substantially constant, whereby variance in discharging is stabilized, while the average speed $\bar{v}$ will be lowered if it exceeds 100° C. From this, it can be understood that the temperature difference ΔT in this case should preferably 20° C. or more and 100° C. or less.

More preferably, when the standard deviation of the liquid discharging speed is negligible to some extent, that is when primarily the discharging speed of the liquid is taken into consideration, ΔT may be 20° C. or more and 60° C. or less, while when the discharging speed of the liquid is negligible to some extent, that is when primarily the above standard deviation is taken into consideration, ΔT may be 25° C. or more and 100° C. or less. Further, most preferably ΔT has been found to be 25° C. or more and 60° C. or less.

Further, in the present invention, the dimensions of the region including the defoaming position where the heat-accumulating layer is made thinner are adequately determined.

Figure 4:
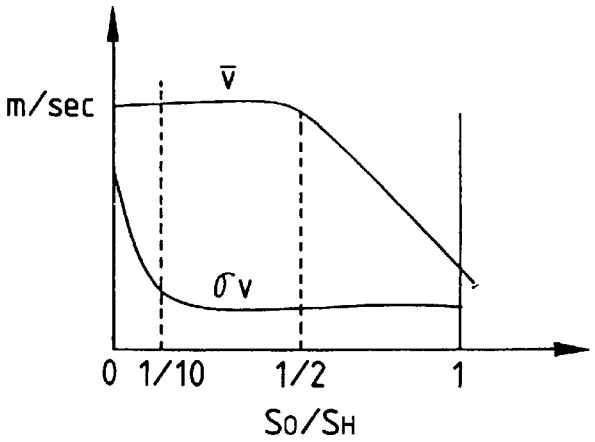
FIG. 4 is similarly a diagrammatic representation or illustration of the area ratio.

FIG. 4 plots $\bar{v}$ and σv versus $S_o/S_H$ of the heat-generating portion area $S_o$ of said region to the whole heat-generating portion area $S_H$. As is apparent from the graph, it has been confirmed that the $\bar{v}$ and σv values are stabilized and discharging performance becomes good when $S_o/S_H$ is made 1/10 to 1/2.

More preferably, when the standard deviation of the discharging speed of the liquid is negligible, that is when primarily the discharging speed of the liquid is taken into consideration, $S_o/S_H$ may be 1/10 to 1/4. On the other hand, when the discharging speed of the liquid is negligible, that is when primarily the above standard deviation is taken into consideration, $S_o/S_H$ may be 1/8 to 1/2. Further, most preferably, $S_o/S_H$ has been found to be 1/8 to 1/4.

EXAMPLE 1

Figure 5A:
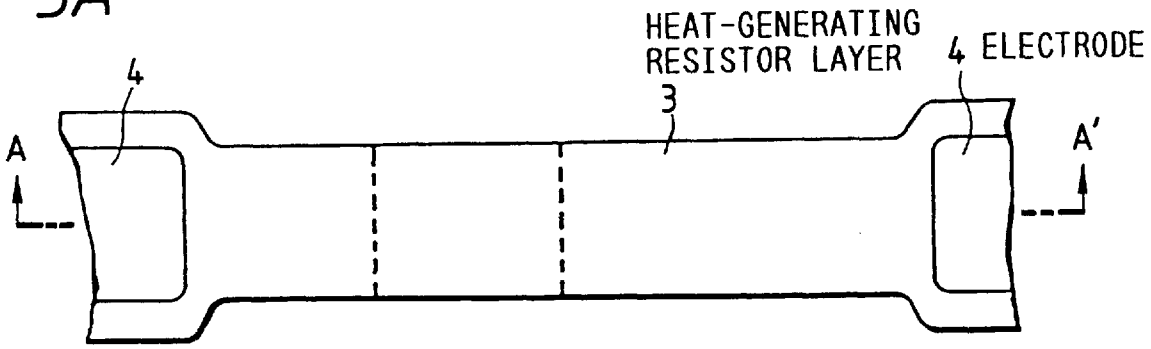
FIGS. 5A and 5B are respectively a plan view showing a first example of the substrate according to the present invention and a sectional view taken along the line A–A' thereof.
Figure 5B:
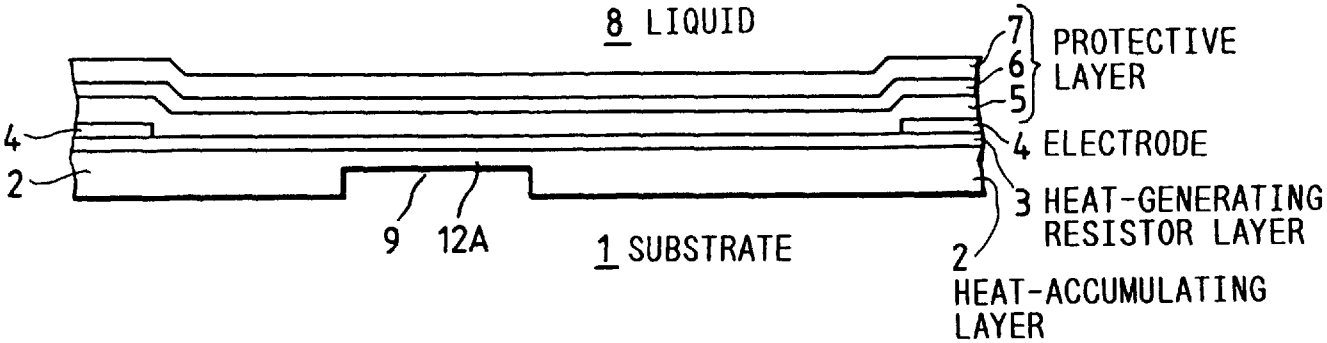

FIGS. 5A and 5B show a first example of the substrate according to the present invention, which are respectively a plan view along the liquid channel direction in FIG. 1A and a sectional view thereof taken along the line A-A'.

Here, 1 is a substrate with a thickness of, for example, 525 μm, and can be formed of a glass or Si, etc. 2 is a $SiO_2$ layer oxidized on the surface with a thickness of 2.5 μm, which is used as the heat-accumulating layer. 3 is a heat-generating resistor layer comprising $HfB_2$ with a thickness of 0.1 μm, a heat-generating portion width of 30 prm and a heat-generating portion length of 150 μm, which is formed by, for example, the sputtering method, having a layer 9 with higher thermal conductivity than the heat-accumulating layer 2 arranged beneath the portion including the position where the bubble disappears (if $l_1$ is made approximate to $l_2$ in the formula (2), around half of the pathway of the current between the electrodes 4). 4's are electrodes Al, etc. with a thickness of 0.5 μm formed by, for example, the EB vapor deposition method.

5 is a layer of $SiO_2$, SiN, etc. with a thickness of 1.5 μm formed by, for example, the sputtering method, 6 a layer of $Ta_2O_5$, etc. with a thickness of 0.1 μm formed by, for example, the sputtering method, 7 a layer of Ta, etc. with a thickness of 0.5 μm formed by the sputtering method, and these layers function as the protective layer. 8 is a liquid (ink) which is to be boiled.

In the present Example, the surface oxidation treatment is inhibited at the portion corresponding to the defoaming position, namely the region 9, whereby the portion 12A corresponding to the region 9 is made thinner in layer film than other portions.

In the present Example, the relationship between the thickness d at the portion 12A which makes the $SiO_2$ oxidized layer 2 thinner and the temperature difference ΔT during blank heating (when current is passed without introduction of ink) is as shown below. In this case, the thickness of other portions is 2.5 μm as described above.

| d (μm) | ΔT (° C.) |
|---|---|
| 1.0 | 179 |
| 1.4 | 100 |
| 1.8 | 50 |
| 2.2 | 20 |
| 2.5 | 0 |

Accordingly, the thickness at the portion which makes the $SiO_2$ oxidized layer thinner at the lower portion of the heat-generating resistor may be appropriately 1.4 μm to 2.2 μm, and the thickness of the portion 12A is selected within that range.

Also, the portion 12A is made to have a width of 30 μm and a length of 40 μm, where $S_o$=30×40 (μm$^2$), $S_H$=30×150 (μm$^2$), $S_o/S_H$=4/15, and therefore the conditions as described with reference to FIG. 4 are also satisfied.

The planar patterns of the heat-generating resistor layer 3 and the electrodes 4 are formed by etching. Also, as is apparent from the drawing, the corners at the connecting portion between the electrodes 4 and the heat-generating resistor layer 3 are rounded such that no lowering in durability or local foaming accompanied with current concentration may occur.

In such an arrangement, when a voltage is applied between the electrodes 4, current will pass through the heat-generating resistor layer 3 to cause heat generation.

The heat generated in the heat-generating resistor layer 3 is transmitted to the lower part and the upper part, but since the heat-accumulating layer is thinner in the region 9, more heat is transmitted to the lower part as compared with other portions. As the result, at the upper part of the layer 9, less heat is transmitted to the liquid 8 through the protective layers 5, 6 and 7 which are upper layers.

Figure 6:
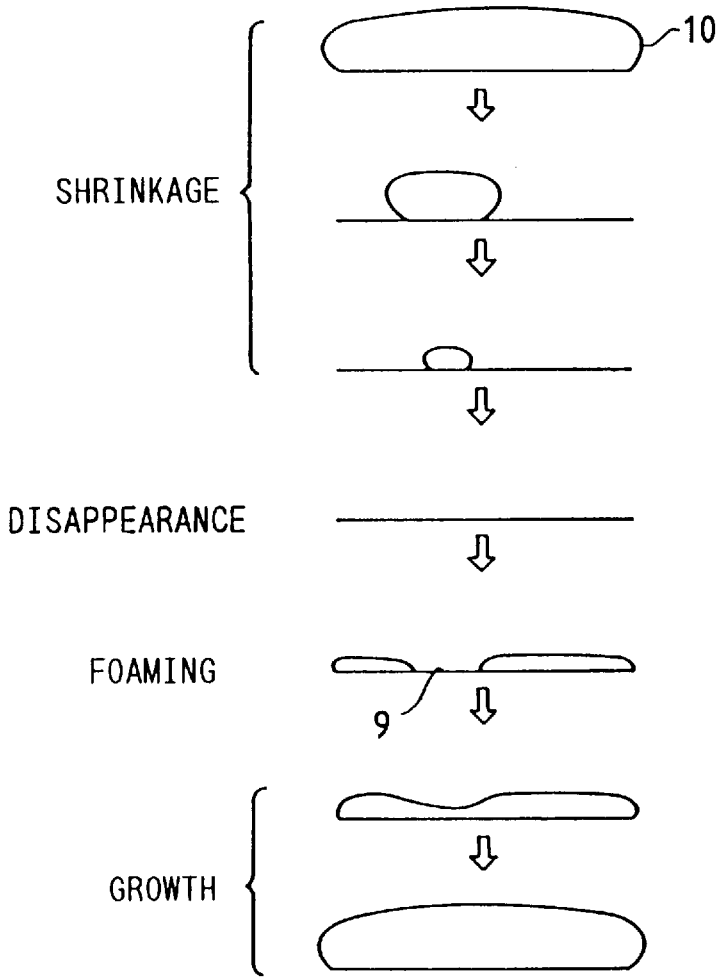
FIG. 6 is an illustration showing the bubble behavior when the present invention is used.

When bubbles are practically generated by use of the substrate according to the present Example, as shown in FIG. 6, it is observed that the bubble 10 disappears at the upper part 3A of the portion of the heat-generating resistor layer 3 corresponding to the region 9, but the heat transmitted to this portion 3A is small in amount and the temperature is lower as compared with the remaining portion. Therefore, even if the residual gas may be attached, no random nucleus boiling will occur to disturb bubble generation, and film boiling with extremely high reproductibility is found to occur from the remaining portion. In this case, the shape and the size of the bubble are constant every time. And, when recording is performed by use of the substrate for the recording head as shown in FIGS. 1A and 1B, droplet diameter and discharging speed also become uniform by adequate selection of the thickness of the portion 2A and the area ratio of the region 9, whereby good images can be obtained.

Reproducibility of boiling at portions other than the upper part 3A of the heat-generating resistor layer 3 corresponding to the region 9 is high, because no residual gas is attached and moreover the liquid 8 is abruptly heated, whereby the liquid 8 reaches the overheating limit to form a bubble through spontaneous nucleus formation phenomenon based on the molecular movement internally of the liquid.

Comparative Example

Figure 7:
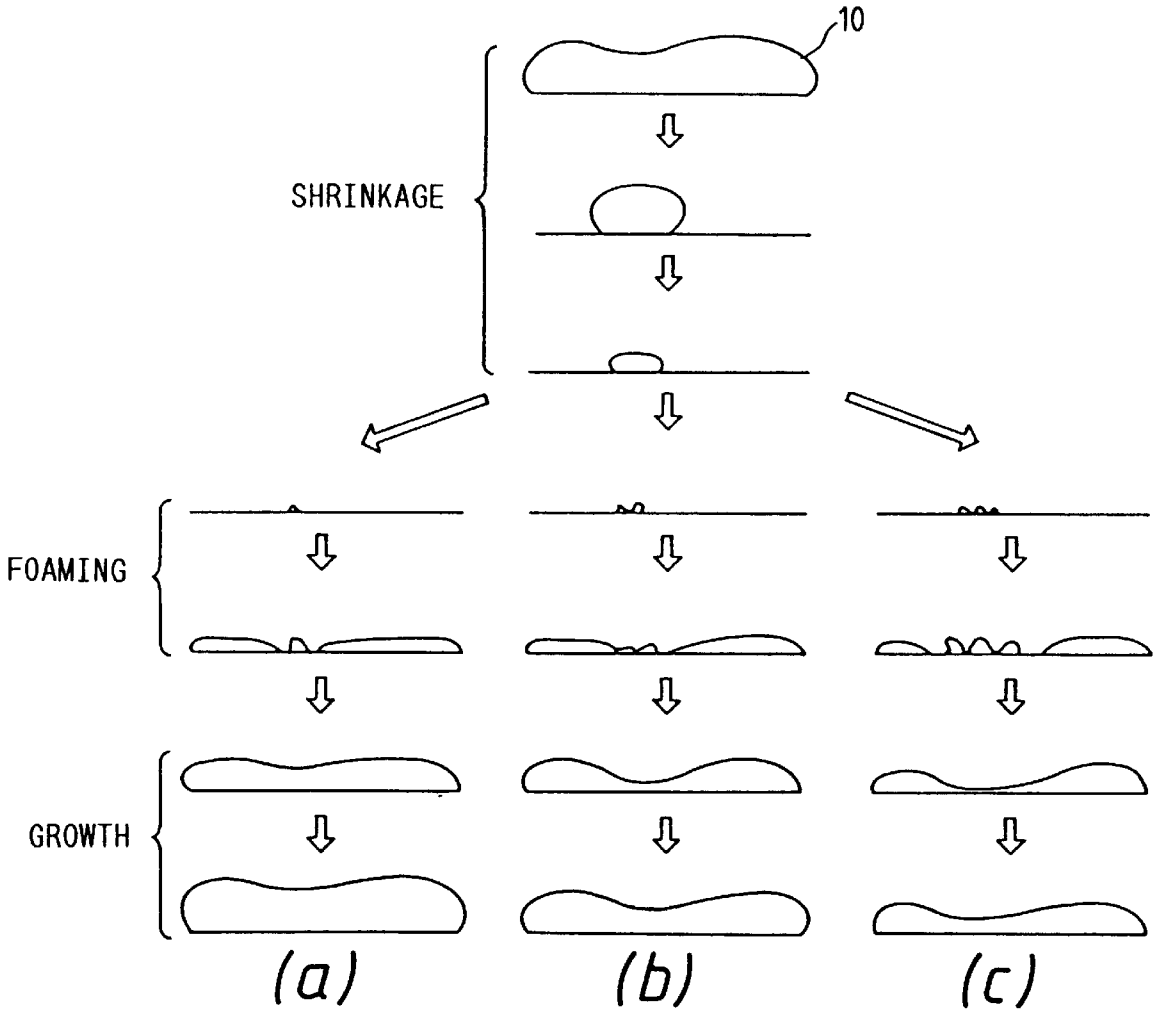
FIG. 7 PRIOR ART
FIG. 7 an illustration showing the bubble behavior in thy prior art example.

FIG. 7 (prior art example) shows the drawing when bubbles are generated by use of the electricity-heat converter comprising the same constitution as the present Example except for providing a heat-accumulating layer with a uniform thickness (2.5 μm) beneath the heat-generating resistor layer 3. As different from the present Example, random nucleus boiling occurs from the place where the bubble 10 disappears, whereby reproducibility of bubble generation is lowered.

More specifically, in the case of the FIG. (a), nucleus boiling occurs at a single position to realize acceptable bubble formation. However no such bubble formation cannot always be achieved. Nucleus boiling may sometimes occur from a plurality of places as shown in the FIG. (b) or (c), and in that case, heat energy will escape into the liquid through nucleus boiling heat transmission to make the bubble volume smaller. In such example, due to the shape and the size of the bubbles not being constant, when recording is performed by a recording head, variance occurs in droplet diameter and discharging speed, thus lowering the quality of the image observed.

Figure 8:
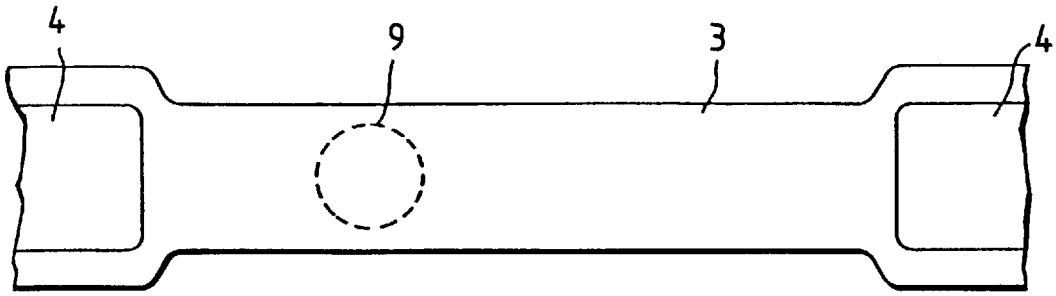
FIG. 8 to FIG. 10 are plan views showing modification examples of the first example.

FIG. 8 shows a modification example of the present Example.

In this example, the region 9 where the oxidized layer of $SiO_2$ (heat-accumulating layer) is made thinner is made circular with a diameter of 28 μm. Here, from $S_o=28^2\pi/4$ (μm$^2$), $S_H$=30×150 (μm$^2$), $S_o/S_H\approx1.7$, and therefore the conditions in FIG. 4 are also satisfied.

Also in this example, the effect equal to that in Example shown in FIGS. 1A and 1B can be obtained.

Figure 9:
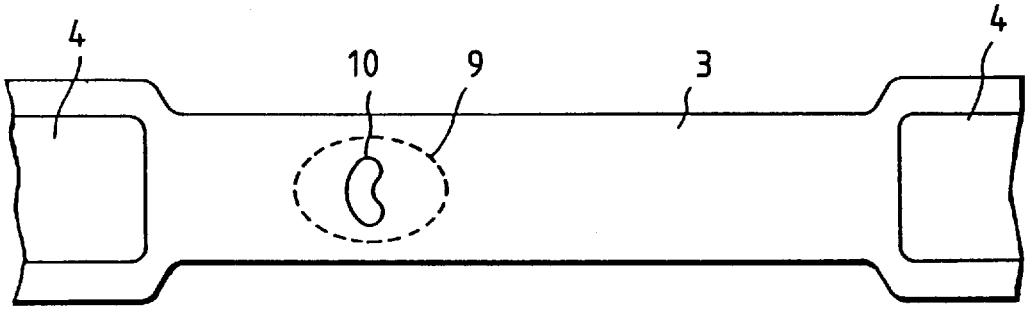

In place of the circular region, the region may be also made ellipsoidal, rectangular, etc. Anyway, the effect of inhibiting nucleus boiling becomes greater by making the upper part of the region 9 to include the site where the bubble 10 disappears internally thereof as shown in FIG. 9 (in the example shown, the region 9 is made ellipsoidal).

Figure 10:
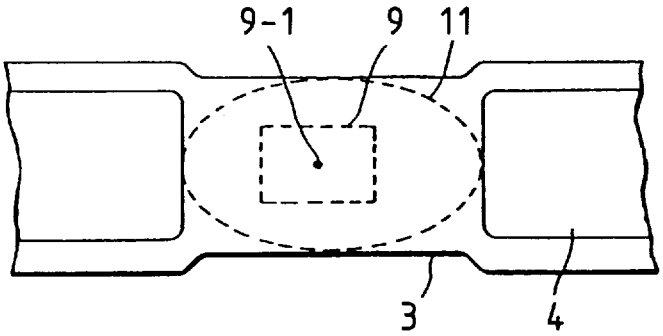

Also, as shown in FIG. 10, the effect of thermal conduction inhibition to the upper part becomes greater by making the central part 9-1 of the region 9 where presence of the heat-accumulating layer is made thinner beneath the inner portion of the circle or the ellipsoid 11 with the maximum area internally contacted with the heat-generating resistor.

Further, by determining adequately the area ratio $S_o/S_H$ of the region surface, σv, $\bar{v}$ values are further stabilized.

EXAMPLE 2

Figure 11:
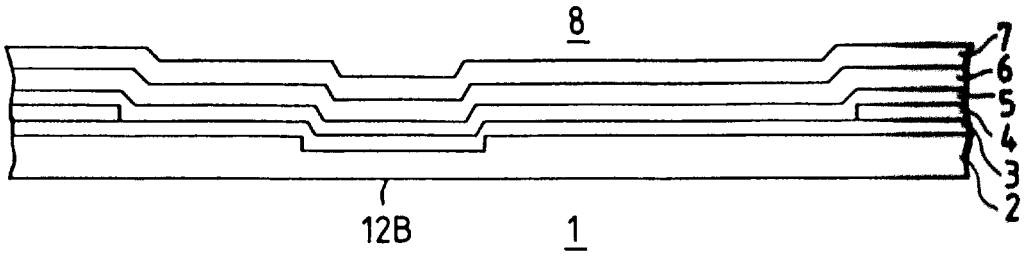
FIG. 11 and FIG. 12 are respective sectional views of the substrates according to a second example and a third example of the present invention.

FIG. 11 shows a second example.

In the present Example, in place of providing the portion of a layer film by inhibiting the surface oxidation treatment, after formation of the oxidized layer 2 of $SiO_2$ with a uniform thickness (for example 2.5 $\mu$m), the layer 2 is worked to become thinner (for example 1.8 $\mu$m) at the portion 12B corresponding to the region 9, and otherwise the same constitution as in FIGS. 5A and 5B is employed.

Also, according to the present Example, the same effect as the example shown in FIGS. 5A and 5B can be obtained, and also a similar modification example can be employed.

EXAMPLE 3

Figure 12:
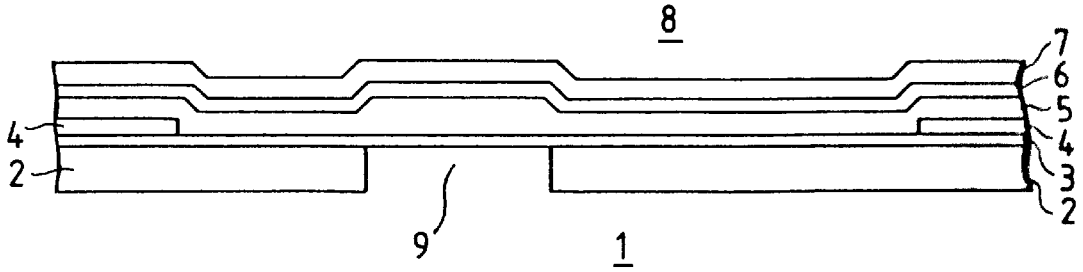

FIG. 12 shows a third example.

In the present Example, the layer 2 was made absent at the portion corresponding to the region 9, and also the thickness of the upper layer (protective layer 5) on the region 9 is made greater. In the present Example, the heat generated at the heat-generating resistor layer 3 is transmitted to the lower part and the upper part, but no heat-accumulating layer is formed in the region 9, but the substrate 1 of Si with high thermal conductivity is directly in contact with the heat-generating resistor layer 3, and therefore more heat is transmitted to the lower part at that portion as compared with other portions. Also, since the protective layer 5 is thicker at the upper part of that portion, heat resistance is greater as compared with other portions. Accordingly, the heat transmitted to the ink from the surface through the protective layers 5, 6 and 7 becomes smaller in amount.

In this case, the thickness of the upper layer 5 is selected so that the above temperature difference $\Delta T$ may be 20° C. to 100° C. under the state where no ink is present. Also, this temperature difference can be obtained by using thinner heat-accumulating layer at the lower part of the region 9 or by using a uniform thickness of the heat-accumulating layer.

In the above three Examples and modification examples thereof, the upper part of the heat-generating resistor layer 9 is made a layer comprising $SiO_2$, $Ta_2O_5$ and Ta, but other constitutions may be employed. Also, particularly in FIGS. 1A and 1B, and FIG. 2, a constitution without an upper layer may be employed.

Further, as the substance forming the lower part layer (heat-accumulating layer), other substances than $SiO_2$ may be available, such as glass, alumina, etc. And, the thickness may be defined as associated with the region 9 adequately corresponding to these materials.

EXAMPLE 4

Figure 13:
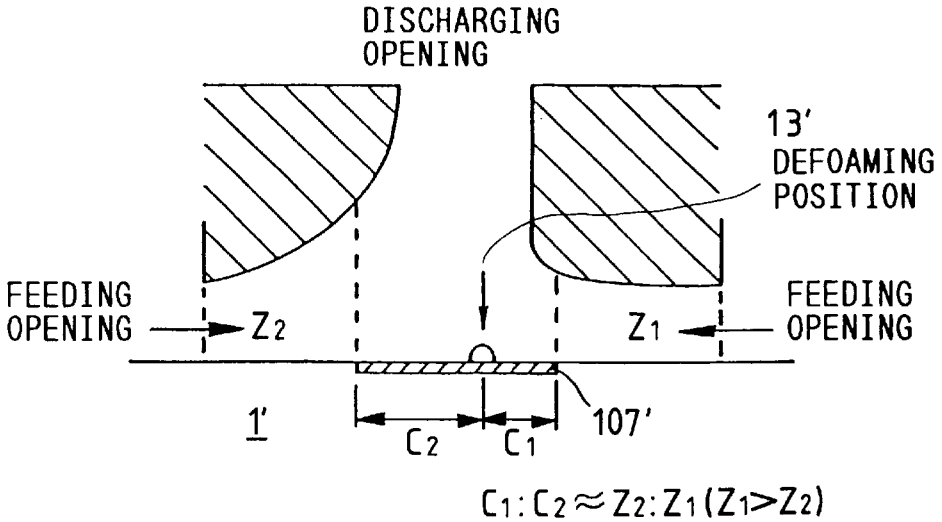
FIG. 13 illustration showing the recording head according to a fourth example of the present invention.

In the above Examples, description has been made about the case in which the present invention is applied to a recording head having a linear liquid channel, but the same effect as described above can be also obtained even in a recording head of the form with different feeding direction and discharoinc direction, for example, the form in which discharging is effected in the vertical direction relative to the substrate 1' as shown in FIG. 13, by employment of the lower part layer of the heat-generating resistor layer 107' or this and the upper layer in the region including the defoaming position 13' shown in the drawing.

Still Other Examples

Also, the present invention is effectively applicable to a recording head having an electricity-heat convertor with a shape capable of gradation expression as developed in recent years, for example, one as disclosed by Japanese Patent Application No. 59-31943 according to the proposal by the present Applicant. That is, it is applicable for a recording head with an electricity-heat converter to have a structure which gives rise to a temperature distribution controllable depending on the level of the signal inputted at the heat-generation portion (heat generation amount control structure), thereby controlling the bubbles in multiple stages depending on the signal level.

Figure 14A:
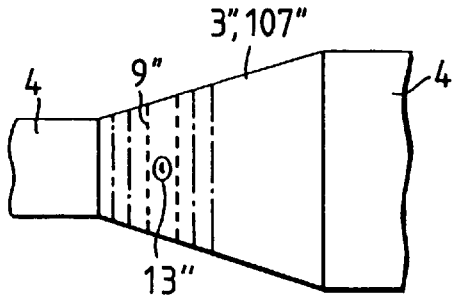
FIGS. 14A–14C are plain view of still other examples of the present invention.
Figure 14B:
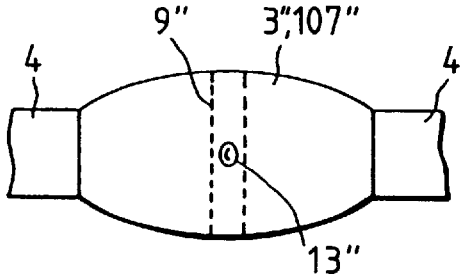
Figure 14C:
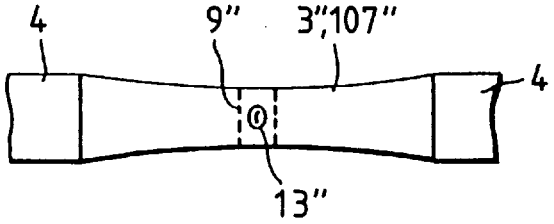

For example, in an electricity-heat converter as shown in FIGS. 14A–14C, if the defoaming position is at the position represented by the symbol 13", there may be provided a region 9" such that the heat-accumulating layer beneath the electricity-heat convertor 107" or the heat-generating resistor layer 3" including that position (the portion indicated by the broken line) is made thinner, etc. Also, when the defoaming positions differ depending on the size of the bubbles formed, a plurality of such regions 9" may be provided (see the portion indicated by the chain line shown in FIG. 14A).

Also, the present invention is applicable to a structure in which the layer thickness of the heat-generating resistor layer is varied along the direction of the current for controlling the bubbles in multiple stages (Japanese Laid-open Patent Application No. 59-31943) and a structure in which the thickness of the heat-generating resistor layer is made thicker stepwise toward the center line side (Japanese Laid-open Patent Application No. 62-201255).

In addition, the present invention is of course not limited to the integration type as shown in FIGS. 1A and 1B, but applicable that any type, provided that an electricity-heat converter is used as the discharging energy generating means, and further applicable to a recording head of the form serially scanned, or a recording head of the full-multi form in which the discharging openings are chosen over the entire width of the recording medium, as a matter of course.

As explained above, the present invention has provided the effect that reproducibility of boiling and thus quality of image obtained are improved by the constitution that the temperature difference under no ink introduction between the surface portion corresponding to the position where bubbles will disappear and of the other surface portions is made within a suitable range.

What is claimed is:

1. A liquid jet recording head for emitting a liquid onto a recording medium, said recording head comprising:

a substrate;

channel means for forming at least one liquid channel defined on said substrate between a feeding opening and a discharge opening;

said substrate having a support and liquid emitting means for emitting liquid, said liquid emitting means having an electricity-heat converter arranged on said support, said electricity-heat converter comprising a heat-generating resistor and a pair of electrodes electrically connected to said heat-generating resistor for supplying an electrical signal thereto to cause it to generate sufficient heat to generate bubbles in liquid passing thereover for causing liquid droplets to be emitted from said liquid emitting means, said heat-generating resistor having a defoaming position therealong where said bubbles disappear after being generated by heat from said heat-generating resistor, said defoaming position being located at distances, $C_1$ and $C_2$, wherein $C_1$ is the distance between the defoaming position and the end of the resistor nearest said discharge opening and wherein $C_2$ is the distance between the defoaming position and the end of the resistor nearest said feeding opening, where the ratio between $C_1$ and $C_2$ is substantially the same as the ratio between distances $L_1$ and $L_2$, wherein $L_1$ is the distance between the end of the resistor nearest the discharge opening and the discharge opening and $L_2$ is the distance between the end of the resistor nearest the feeding opening and the feeding opening, said substrate having a higher heat dissipation characteristic in the region of said defoaming position than in the other regions of said resistor such that the temperature $T_o$ at said defoaming position is less than the highest temperature $T_H$ in the remaining portions of said resistor by an amount in the range of 20°–100° C. when said heat generating resistor is supplied with said electrical signal wherein $T_o$ is the peak value of the surface temperature of a portion of said resistor corresponding to said defoaming position and wherein $T_H$ is the overall peak value of the surface temperature of the resistor;

whereby bubble size is maintained uniform for successive driving of said recording head so as to form images of high quality.

2. A liquid jet recording head according to claim 1, wherein said amount ΔT is preferably 20° C. or more and 60° C. or less when primarily discharging speed of the liquid for recording is taken into consideration, or 25° C. or more and 100° C. or less when primarily standard deviation of the discharging speed of the liquid for recording is taken into consideration, or most preferably said amount ΔT is 25° C. or more and 60° C. or less.

3. A liquid jet recording head according to claim 1, further comprising a heat accumulating layer said support and said electricity-heat converter, said heat-accumulating layer being adapted to be made thinner at a site corresponding to said defoaming position so as to obtain said temperature difference amount ΔT.

4. A liquid jet recording head according to claim 1, wherein said electricity-heat converter has a protective layer as an upper layer, said protective layer being adapted to be made thicker at a site corresponding to said defoaming position so as to obtain said temperature difference amount ΔT.

5. A liquid jet recording head according to claim 3 or 4, wherein a ratio $S_o/S_H$ of an area $S_o$ on said heat-generating resistor corresponding to said defoaming portion to an entire area $S_H$ on said heat-generating resistor is made preferably 1/10 to 1/2, and more preferably 1/10 to 1/4 when primarily discharging speed of the liquid is taken into consideration, or 1/8 to 1/2 when primarily standard deviation of the discharging speed of the liquid is taken into consideration, or most preferably 1/8 to 1/4.

6. A method of making a recording device for recording on a recording medium by emitting a liquid using a liquid jet head, said method comprising the steps of:

forming on a substrate, a channel which extends between a feeding opening and a discharging opening;

providing in said channel electricity-heat converter comprising a heat-generating resistor layer and a pair of electrodes electrically connected to said heat-generating resistor layer for supplying driving signals thereto to cause it to generate sufficient heat to generate bubbles in liquid passing thereover for causing liquid droplets to be emitted from said discharging opening;

said heat-generating resistor layer between the pair of electrodes having a particular defoaming position therealong where bubbles disappear after being generated by heat from said heat-generating resistor layer, said defoaming position being located at distances $C_1$ and $C_2$ from the opposite ends of the heat generating resistor layer between said electrodes, wherein $C_1$ is the distance between the defoaming position and the end of the resistor nearest said discharging opening and wherein $C_2$ is the distance between the defoaming position and the end of the resistor nearest said feeding opening, and where the ratio between $C_1$ and $C_2$ is substantially the same as the ratio between the corresponding distances $L_1$ and $L_2$ from the ends of the heat-generating resistor layer between the electrodes to the respective ends of said liquid flow channel, wherein $L_1$ is the distance between the end of the resistor nearest the discharge opening and the discharging opening and $L_2$ is the distance between the end of the resistor nearest the feeding opening and the feeding opening; and forming said electricity-heat converter to have a higher heat dissipation characteristic in said defoaming position than in the other regions of said heat-generating resistor between said electrodes than in the other regions of said heat-generating resistor between said electrodes, said higher heat dissipation characteristic being sufficient to cause the peak temperature at said defoaming position to be less than the peak temperature in the remaining portions of said heat-generating resistor between said electrodes by an amount in the range of 20° to 100° C. when said driving signals are applied to said heat-generating resistor layer in the absence of liquid;

whereby bubble size is maintained uniform for successive driving of said recording head so as to form images of high quality.

7. A method for recording according to claim 6, wherein said amount ΔT is preferably 20° C. or more and 60° C. or less when primarily discharging speed of the liquid for recording is taken into consideration, or 25° C. or more and 100° C. or less when primarily standard deviation of the discharging speed of the liquid for recording is taken into consideration, or most preferably said amount ΔT is 25° C. or more and 60° C. or less.

8. A method according to claim 6, wherein the liquid jet head further includes a heat-accumulating layer between a support and the electricity-heat converter, the heat-accumulating layer being adapted to be made thinner at a site corresponding to the defoaming position so as to obtain said temperature difference amount ΔT.

9. A method according to claim 6, wherein the electricity-heat converter has a protective layer as an upper layer, with the protective layer being adapted to be made thicker at a site corresponding to the defoaming position so as to obtain the temperature difference amount ΔT.

10. A method according to claim 8 or 9, wherein a ratio $S_o/S_H$ of an area $S_o$ on said heat-generating resistor corresponding to the defoaming position to an entire area $S_H$ on said heat-generating resistor is made preferably 1/10 to 1/2, and more preferably 1/10 to 1/4 when primarily discharging speed of the liquid is taken into consideration, or 1/8 to 1/2 when primarily standard deviation of the discharging speed of the liquid is taken into consideration, or most preferably 1/8 to 1/4.

* * * * *

UNITED STATES PATENT AND TRADEMARK OFFICE

CERTIFICATE OF CORRECTION

PATENT NO. : 5,892,526

DATED : April 6, 1999

INVENTOR(S) : AKIRA ASUI

It is certified that error appears in the above-identified patent and that said Letters Patent is hereby corrected as shown below:

On the title page, item

[56] REFERENCES CITED

Other Publications
"A, Asai, et al.," should read --A. Asai, et al.,--.

[57] ABSTRACT

Line 6, "of of" should read --of--.
Line 7, "deforming" should read --defoaming-.

COLUMN 1

Line 39, "system," should read --system--.
Line 49, "disclose" should read --discloses--.
Line 50, "relations" should read --relation--.
Line 60, "position" should read --portion--; and "mainbubbles" should read --main bubbles--.
Line 63, "directional" should read --direction--.

UNITED STATES PATENT AND TRADEMARK OFFICE

CERTIFICATE OF CORRECTION

PATENT NO. : 5,892,526

DATED : April 6, 1999

INVENTOR(S) : AKIRA ASUI

It is certified that error appears in the above-identified patent and that said Letters Patent is hereby corrected as shown below:

COLUMN 2

Line 33, "to" should be deleted.
Line 38, "be" should read --been--.

COLUMN 3

Line 36, "heat-generating" should read --heat-generating resistor layer between the pair of electrodes, with the heat-generating--.
Line 38, "deforming" should read --defoaming-.
Line 40, "deforming" should read --defoaming-.
Line 57, "illustration" should read --illustration of--.
Line 61, "or" should read --for--.

COLUMN 4

Line 3, "FIG. 7" should read --FIG. 7 is--; and "thy" Should read --the--.
Line 10, "FIG. 13" should read --FIG. 13 is an--.
Line 12, "plain view" should read --plan views--.

UNITED STATES PATENT AND TRADEMARK OFFICE

CERTIFICATE OF CORRECTION

PATENT NO. : 5,892,526

DATED : April 6, 1999

INVENTOR(S) : AKIRA ASUI

It is certified that error appears in the above-identified patent and that said Letters Patent is hereby corrected as shown below:

COLUMN 5

Line 14, "subsrate" should read --substrate--.
Line 22, "and" should read --and also--.
Line 23, "also" should be deleted.

COLUMN 6

Line 27, "preferably" should read --preferably be--.
Line 67, "prm" should read --μm-.

COLUMN 8

Line 34, "However no" should read --However,--.

COLUMN 9

Line 57, "discharoinc" should read --discharging--.

COLUMN 10

Line 32, "that" (first occurrence) should read --to--.

UNITED STATES PATENT AND TRADEMARK OFFICE

CERTIFICATE OF CORRECTION

PATENT NO. : 5,892,526

DATED : April 6, 1999

INVENTOR(S) : AKIRA ASUI

It is certified that error appears in the above-identified patent and that said Letters Patent is hereby corrected as shown below:

COLUMN 11

Line 25, "ΔT" should be deleted.
Line 30, "ΔT" should be deleted.
Line 33, "heat accumulating layer" should read --heat-accumulating layer between--.
Line 37, "amount ΔT." should read --amount.--.
Line 42, "amount." should read --amount.--.
Line 43, "ΔT." should be deleted.

COLUMN 12

Line 40, "ΔT" should be deleted.
Line 45, "ΔT" should be deleted.
Line 47, "method" should read --method for recording--.
Line 52, "amount ΔT." should read --amount.--.
Line 53, "method" should read --method for recording--.
Line 56, "the" (second occurrence) should read --said--.
Line 57, "amount ΔT." should read --amount.--

UNITED STATES PATENT AND TRADEMARK OFFICE

CERTIFICATE OF CORRECTION

PATENT NO. : 5,892,526

DATED : April 6, 1999

INVENTOR(S) : AKIRA ASUI

It is certified that error appears in the above-identified patent and that said Letters Patent is hereby corrected as shown below:

COLUMN 12

Line 58, "method" should read --method for recording--.

Signed and Sealed this

Twenty-eighth Day of March, 2000

*Attest:*

Q. TODD DICKINSON

*Attesting Officer*

*Commissioner of Patents and Trademarks*